US010190852B2

(12) United States Patent
Christians et al.

(10) Patent No.: US 10,190,852 B2
(45) Date of Patent: Jan. 29, 2019

(54) DEVICE FOR SIMULATING A MORTAR

(71) Applicant: Rheinmetall Defence Electronics GmbH, Bremen (DE)

(72) Inventors: Ernst Christians, Henstedt-Ulzburg (DE); Andree Hornhardt, Weyhe (DE); Wolfgang Pietz, Thedinghausen (DE); Holger Zielke, Bremen (DE)

(73) Assignee: RHEINMETALL DEFENCE ELECTRONICS GMBH, Bremen (DE)

( * ) Notice: Subject to any disclaimer, the term of this patent is extended or adjusted under 35 U.S.C. 154(b) by 264 days.

(21) Appl. No.: 14/902,669

(22) PCT Filed: Jul. 3, 2014

(86) PCT No.: PCT/EP2014/064261
§ 371 (c)(1),
(2) Date: Jan. 4, 2016

(87) PCT Pub. No.: WO2015/001060
PCT Pub. Date: Jan. 8, 2015

(65) Prior Publication Data

US 2016/0169626 A1 Jun. 16, 2016

(30) Foreign Application Priority Data

Jul. 3, 2013 (DE) ..... 10 2013 213 001

(51) Int. Cl.
*F41A 33/00* (2006.01)
*F41G 3/26* (2006.01)
(Continued)

(52) U.S. Cl.
CPC ..... *F41G 3/26* (2013.01); *F41A 21/10* (2013.01); *F41A 33/00* (2013.01); *F41F 1/06* (2013.01)

(58) Field of Classification Search
USPC ..... 434/11, 12, 16, 19, 24; 102/444, 445
See application file for complete search history.

(56) References Cited

U.S. PATENT DOCUMENTS 2,308,798 A * 1/1943 Peiker ..... F41B 11/00 102/444
2,809,624 A * 10/1957 Becher ..... F41A 33/00 124/77

(Continued)

FOREIGN PATENT DOCUMENTS

DE 19806911 A1 9/1999
KR 20120027772 A 3/2012

OTHER PUBLICATIONS

International Search Report of PCT/EP2014/064261, dated Oct. 7, 2014.

(Continued)

*Primary Examiner* — Kurt Fernstrom
(74) *Attorney, Agent, or Firm* — Venable, LLP; Jeffri A. Kaminski

(57) ABSTRACT

The invention relates to a mortar (1) comprising a stand (2) disposed on a mortar barrel (3), and a base plate (4) for setting up the mortar (1), characterized in that a device (10) for simulating the function of the mortar (1) is provided, wherein in a neutral position said device (10) is arranged almost completely inside the mortar barrel (3) and in an operating position from the mortar barrel (3) said device is arranged such that it protrudes from the mortar barrel (3) relative to the neutral position.

9 Claims, 3 Drawing Sheets

Figure 1:
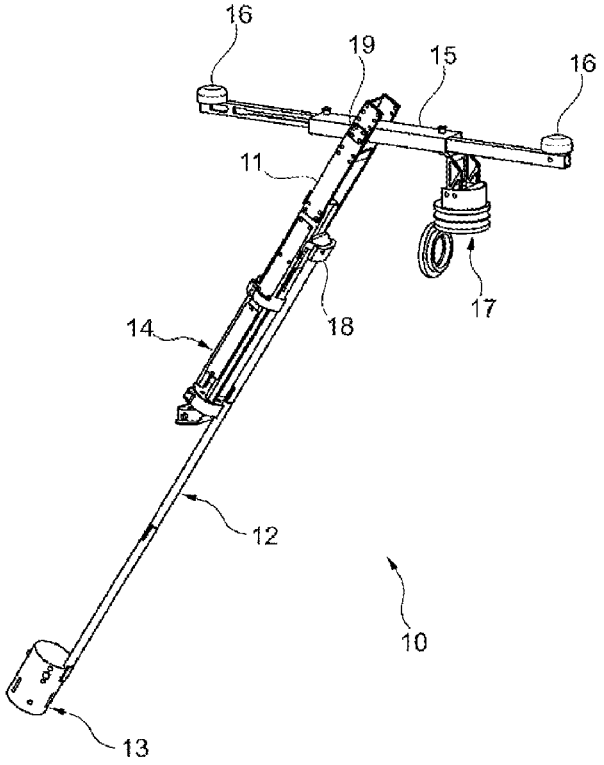

(51) Int. Cl.
*F41A 21/10* (2006.01)
*F41F 1/06* (2006.01)

(56) References Cited

U.S. PATENT DOCUMENTS 2,821,923 A * 2/1958 Alderson ..... F42B 8/10
102/372
4,326,847 A * 4/1982 Roe ..... F41A 33/00
434/12
4,427,386 A * 1/1984 Fields ..... F41G 3/26
434/19
4,711,180 A * 12/1987 Smolnik ..... F42B 8/10
102/372
6,059,573 A * 5/2000 Patel ..... F41G 3/30
434/16
6,193,517 B1 2/2001 Lazecki
7,421,934 B1 * 9/2008 Madulka ..... F41A 33/00
102/445

OTHER PUBLICATIONS

Singaporean Search Report mailed in corresponding Singaporean Application No. 11201510743X dated Oct. 5, 2018 (1 page).

* cited by examiner operationally ready pushed-in

DEVICE FOR SIMULATING A MORTAR

CROSS-REFERENCE TO RELATED APPLICATION

This application is a U.S. National Phase of International Application No. PCT/EP2014/064261, filed Jul. 3, 2014, which claims priority to German Application No. 102013213001.5, filed Jul. 3, 2013, the entire contents of each are incorporated by reference herein.

DESCRIPTION

The invention relates to a mortar, comprising a stand, which is arranged on a mortar barrel, and also a base plate for setting up the mortar, according to the features of the preamble of patent claim 1.

The invention is based on the object of providing a mortar which makes it possible to avoid the disadvantages described at the beginning and providing a mortar which is operationally ready, that is to say can be used for original ammunition, and the function of which can be simulated without live ammunition. This object is achieved by the features of patent claim 1.

According to the invention, a device for simulating the function of the mortar is provided, this device being arranged almost completely in the mortar barrel in a neutral position and protruding from the mortar barrel in an operational position out of the mortar barrel in comparison with the neutral position. This provides a device having all the elements for simulating the function of the mortar, which is arranged almost completely, in particular completely, in the mortar, in the mortar barrel thereof, in a neutral position, in particular during the transport or unused phases of the mortar. While the mortar is being operated to simulate its function, the device is extended out of the mortar tube. However, to bring the device into the operational position, this is only performed to the extent that part of the device remains in the mortar barrel. This has the advantage that the other elements with which actual live firing of the mortar can be triggered can also be used to put the device into operation for simulating the function of the mortar. Furthermore, as a result this device continues to be stored and held in the mortar barrel, and so it is advantageously possible to dispense with additional elements for attaching the device to the mortar itself or outside.

In a development of the invention, the device for simulating the function of the mortar comprises a trigger box, a control unit, at least one antenna, preferably two antennas arranged at a distance from one another, and also an operating unit. The trigger box makes it possible to capture the usual triggering for live firing of the mortar and transmit it to the device for simulating the function of the mortar. This triggering signal and further signals are fed to a control unit, which processes the fed signals and simulates the function of the mortar. The fed signals also include the signals captured by the at least one antenna and the signals that are input by an operator by way of the operating unit for controlling the device. By way of the at least one antenna, preferably two antennas, or preferably two GNSS antennas, the position and/or the alignment of the mortar, in particular the mortar barrel, with respect to an aimed-at target is captured. By way of the operating unit, inputs can be made by an operator. In addition or as an alternative to this, the operating unit is also designed to output items of information, in particular optically and/or acoustically, for example on a screen. The aforementioned elements of the device are all advantageously arranged or integrated in or on the device for simulating the function of the mortar, and so as a result a compact type of construction is obtained. The compact type of construction has the advantage that the device as a whole can be accommodated in the mortar barrel during the neutral position of the function.

In a development of the invention, the device comprises a carrier and a further carrier that is pivotable in relation thereto, the longitudinal axis of the carrier being arranged in the longitudinal axis of the mortar barrel both in the neutral position and in the operating position of the device. This type of construction likewise has the advantage that the device as a whole can be arranged with its elements for simulating the function of the mortar in the mortar barrel during the neutral position. The one carrier remains in the longitudinal axis of the mortar barrel both in the neutral position and in the operating position. That is to say that this carrier can be extended or retracted axially in relation to the mortar barrel. Preferably, in the neutral position this carrier is fully retracted into the mortar barrel and/or in the operating position remains in part, particular in a small part, in the mortar barrel. In addition, it is of course conceivable that in the operating position this carrier is fully extended from the mortar barrel and is held on the latter by way of further elements that are present on it and/or are present on the mortar barrel. Arranged on this one carrier is a further carrier, which is pivotable. The pivotability has on the one hand the advantage that the first carrier can be aligned together with the further carrier in line with one another, in order to be able to retract these two carriers into the mortar barrel. It is also of advantage that the further carrier pivots, in particular can be pivoted in an angular range between 75 and 105 degrees, in particular approximately by 90 degrees. This allows the at least one antenna, in particular the at least two antennas, to be arranged on this pivotable further carrier, in particular in the end region thereof, while this further carrier is pivoted with respect to the one carrier and is in the operating position. This allows the at least one antenna to be brought to a distance from the mortar barrel consisting of metal, and so as a result disturbances of the high-frequency signals received (and/or possibly transmitted) by way of the antenna can be avoided. This of course also applies to the case where an antenna is respectively arranged in the end region of this pivoted further carrier, therefore altogether two antennas are arranged.

In a development of the invention, the one carrier, that is the carrier that remains in the mortar barrel and is only extended in part, is provided with a guiding linkage that is movable in the longitudinal direction. This has the advantage that the device can be adapted to different lengths of mortar barrels. It is also of advantage that the trigger box is arranged at the one end of the guiding linkage and the other end of the guiding linkage is connected to the carrier. This makes it possible that the trigger box always remains in the region of the trigger of the mortar, that is to say the carrier on which the control unit is arranged, but can be displaced axially inside the mortar barrel and can be moved out in part from the mortar barrel. Advantageously, when the carrier is moved out from the mortar barrel, the control unit remains inside the mortar barrel, and so as a result it is arranged in a protected manner. As an alternative to this, in the operating position it may however also be extended from the mortar barrel, and consequently accessible. This has the advantage in particular whenever the control unit either has an operating unit of its own or whenever the single operating unit is a component part of the control unit. In this case it is possible to dispense with the arrangement of an operating unit on the pivotable further carrier.

In a development of the invention, the trigger box is arranged at the end of the carrier that is remote from the further carrier. In this case, the trigger box is arranged directly at the one end of the carrier. During the neutral position of the device for simulating the function of the mortar, consequently all of the elements of this device are located inside the mortar barrel. In order to bring them into the operating position, the carrier is extended and the further carrier is pivoted outside the mortar barrel, that is to say is brought into its operating position. In this operation, the trigger box moves away from the triggering mechanism of the mortar. However when the carrier is pushed in again inside the mortar barrel, but at the same time the further carrier remains pivoted, in this way the device can likewise be brought into an operating position. Then the trigger box again enters the region of the trigger, and so the latter can trigger the simulation of the function of the mortar, which is captured by the trigger box and passed on to the control unit.

In a development of the invention, the control unit is arranged on the carrier arranged inside the mortar barrel. As a result, a particularly compact type of construction is obtained. At the same time, the control unit is arranged in a protected manner by the mortar barrel, in particular during the neutral position, but also possibly while the carrier is being brought into the operating position. It is alternatively conceivable that the carrier that is axially displaceable in the mortar barrel is moved out of the mortar barrel, and the control unit is arranged on the carrier, to the extent that the control unit is thereby likewise moved out of the mortar barrel. As a result, the control unit is accessible in particular for the purpose of exchange or repair.

In a development of the invention, the at least one antenna, in particular the precisely two antennas, is/are arranged respectively in an end region of the further pivotable carrier. This allows the antennas (or the one antenna) to be retracted together with the pivotable further carrier into the mortar barrel when this further carrier is aligned axially in line with the one carrier located in the mortar barrel. If this carrier that is axially displaceable in the mortar barrel is extended, it is possible to pivot the further carrier, and thereby bring the at least one antenna into its operating position, in particular at a distance from the mortar barrel, in order to avoid signal disturbances. Furthermore, the emission or reception of signals by the at least one antenna is significantly improved as a result.

In a development of the invention, at least one linkage is provided on the further pivotable carrier, movably in relation thereto, the one end of the linkage being mounted on the pivotable carrier and the antenna being arranged at the other end of the linkage. This linkage allows the antenna to be brought to a still greater distance from the further pivotable carrier or the mortar tube. As a result, the functional accuracy of the device as a whole for simulating the device of the mortar advantageously increases. To achieve a particularly compact type of construction, the at least one linkage is movably arranged axially in relation to the further pivotable carrier. As a result, not only a compact type of construction is obtained, but also the user-friendliness is increased and the linkage cannot be lost, since, though it is arranged movably, in particular axially displaceably, on the further end, it does not form an independent component and is consequently arranged captively on the carrier. The linkage may of course also be present and mounted separately from the further carrier and the antenna, this however being to the detriment of user-friendliness. However, this makes it possible that such a linkage is made possible for a certain type of construction of a mortar and not for another type of construction of another mortar. There is consequently a flexibility of the distance of the at least one antenna with respect to the mortar barrel. Apart from the axial displaceability of the linkage with respect to the further pivotable carrier, other fastening possibilities also come into consideration. For example, the linkage may be arranged about a turning point on the further carrier. It is likewise conceivable that the linkage has in its end region a thread by which it is screwed into a corresponding mating thread in the further carrier. Similarly, latching and clamping connections and comparable connections are conceivable.

In a development of the invention, the operating unit is arranged on the further carrier. As a result, the operating unit is accessible when the carrier arranged in the mortar barrel is pushed axially out from it. Then, the further carrier is likewise accessible, can be pivoted and the operating unit becomes accessible as a result. Conversely, this means that the operating unit during the neutral position, that is to say when the two carriers are aligned in line with one another and are located in the mortar barrel, the operating unit is likewise arranged in a protected manner in the mortar barrel. Particularly advantageously, the operating unit closes the open end of the mortar barrel in the neutral position of the device for simulating the function of the mortar. For this purpose, part of the operating unit, in particular part of the housing of the operating unit, is designed to be particularly robust and is geometrically adapted to the opening or the peripheral region at the end of the mortar barrel. As a result, by this part of the housing of the operating unit, the region at the end of the mortar barrel is closed by this part of the operating unit. As a result, the entire device for simulating the function of the mortar located in the neutral position is arranged in a protected manner in the mortar barrel and no parts can be lost.

The description of the invention is briefly given once again below with the same content using different words.

An exemplary embodiment of the invention is represented in FIGS. 1 to 4 and is explained in more detail below.

Figure 2:
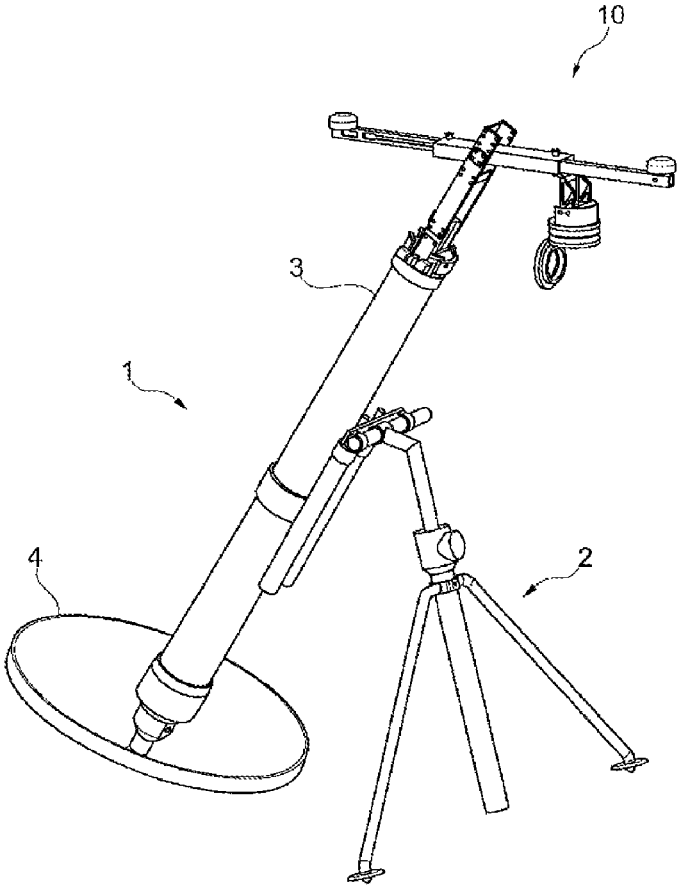
Figure 4:
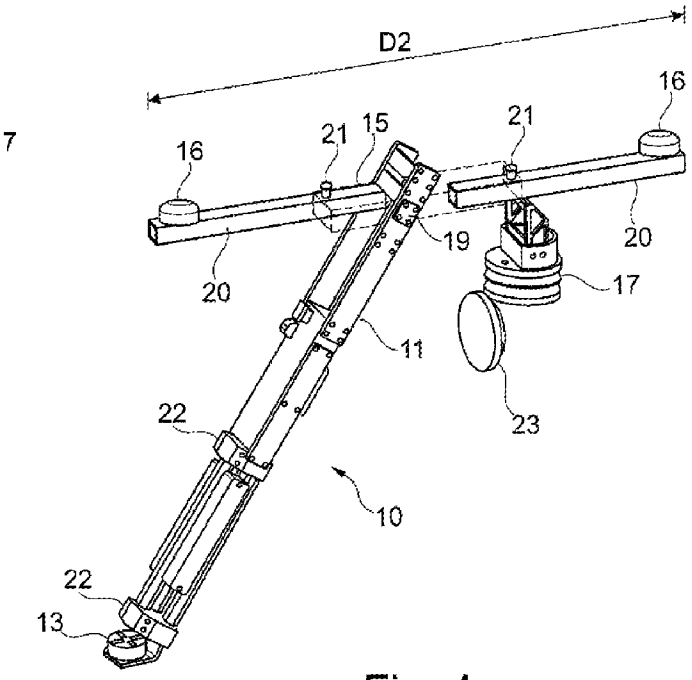
Figure 3:
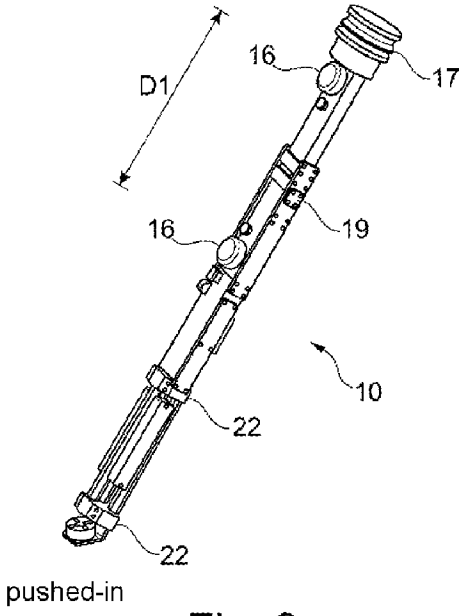

In the figures:

FIG. 1 shows a device for simulating the function of a mortar (without representation of the mortar), FIG. 2 shows a mortar with its elements that are known per se, including the device according to the invention for simulating its function, FIG. 3 shows the simulation device according to the invention in the state it is in when it has been pushed into the mortar, FIG. 4 shows the simulation device according to the invention in its operationally ready position.

As specifically represented, the exemplary embodiment of a device 10 for simulating the function of a mortar exhibits a carrier 11. Looking at FIG. 2, this carrier 11 is accommodated in a mortar 1. The mortar 1 of FIG. 2 comprises in a way known per se a stand 2, a mortar barrel 3 and also a base plate 4. With the movable, possibly multi-part stand 2 and the base plate 4, a mortar 1 that is functional in a way known per se is set up at its intended location and can fire at a steep angle in order to be able to engage targets behind cover. For this purpose, actually live ammunition is used. In order however to avoid the use of live ammunition, but nevertheless be able to simulate the function of the mortar 1, the device 10, represented in detail in FIG. 1, is inserted into the mortar barrel 3.

While in FIG. 2 the mortar 1 is represented with the device 10 in the operationally ready position (operating position), in FIG. 1 this device 10 is represented without the mortar 1 to illustrate the individual elements.

While the carrier 11 is arranged in the mortar barrel 3 and can be moved axially in this mortar barrel 3, according to the exemplary embodiment that is shown in FIG. 1 a guiding linkage 12 is arranged at the end of the carrier 11. The guiding linkage 12 may be arranged fixedly or relatively movably in relation to the carrier 1. Arranged at the end of the guiding linkage 12 that is remote from the carrier 11 is a trigger box 13. In the operating position of the device 10, the trigger box 13 must be located in the region in which the actual trigger of the mortar 1 (not represented here) is located. While the device 10 is being brought from the neutral position into the operating position, or vice versa, the trigger box 13 may remain in the region of the trigger of the mortar 1 or be moved away from it or moved toward it.

Also provided is a control unit 14, this control unit 14 being arranged on the carrier 11. At this stage it should be pointed out that generally the carrier 11 may be of a one-part form. It is also conceivable that the carrier 11 is of a multi-part form, as represented in the case of the exemplary embodiment according to FIG. 1. Whether the carrier 11 is of a one-part or multi-part form depends not only on the type of construction of the device 10 but also on the space available inside the mortar barrel 3 of the mortar 1. In the case of short mortar barrels 3, it is appropriate to design the carrier 11 in a one-part form. If the mortar barrel 3 exceeds a certain length, it may be appropriate to design the carrier 11 in a multi-part form. This allows a kind of modular system to be realized. Instead of the simply designed guiding linkage 12, it is similarly conceivable to make the one-part or multi-part carrier 11 axially so long that the trigger box can be arranged in its end region.

Arranged at the end of the carrier 11 protruding from the mortar barrel in the operating position of the device 10 is a further carrier 15. This carrier 15 is arranged fixedly with the carrier 11, but movably in relation thereto. As a result, a compact type of construction is achieved and the carrier 15 can be pushed together with the carrier 11 into the mortar barrel 3 or pushed out of it when the two carriers 11, 15 are arranged in line with one another. In this case, either only the carrier 11 or only the carrier 15 or both carriers 11, 15 together form(s) such an outer geometry that makes it possible to push the two together into the mortar barrel 3. In particular, this geometry is designed for the purpose of realizing a guide during the movement from the neutral position into the operating position, or vice versa.

Arranged at the end of the carrier 15 is at least one antenna 16. In the case of the exemplary embodiment according to FIG. 1, two antennas 16 are present. These are kept at the greatest possible distance by the carrier 15. Furthermore, the geometry of the at least one antenna 16, possibly of the carrier 11, is chosen such that in the neutral position the at least one antenna 16 can be accommodated by the carrier 11 and at the same time can also be retracted into the mortar barrel 3. If two antennas 16 are present, this of course also applies to both antenna 16.

An operating unit 17 is also provided. The operating unit 17 is advantageously provided on the carrier 15. It is ensured by this arrangement that the operating unit 17 can also be retracted into the mortar barrel 3 when the two carriers 11, 15 are aligned in line with one another. Particularly advantageously, the end of the mortar barrel 3 is closed by the operating unit 17.

As stated above, the carrier 11 or the carrier 15 or both carriers 11, 15 together form(s) the geometry which makes it possible that the device 10 is mounted or guided for the purpose of axial movement in the mortar barrel 3. As an alternative or in addition to this, it is possible to attach a linear guide 18 as an additional element to one of the two carriers 11, 15 or else to both carriers 11, 15. The additional element of the linear guide 18 has the advantage that standard geometries can be used for the carrier 11 and/or the carrier 15 and with the element of the linear guide 18 can be adapted to different geometries of the mortar barrel, in particular to different inside diameters. For this purpose, the linear guide 18 is simply exchanged for another. The flexibility of the use of the device 10 for simulating the function of the mortar 1 advantageously increases as a result.

Likewise as explained above, the carrier 15 is arranged movably and captively on the carrier 11. This takes place in particular by the carrier 15 being arranged about a pivoting point 19 on the carrier 11. As an alternative to means for allowing the carrier 15 to be pivoted about the pivoting point 19 on the carrier 11, other alternatives for the captive fastening, but also simultaneous movement of the carrier 15 in relation to the carrier 11 may also be provided. Here it may be considered to arrange the carrier 15 on the carrier 11 by way of a screwing connection, a clamping connection, a latching connection or the like. However, the proposed solution of the captive pivoting of the carrier 15 on the carrier 11 is of particular advantage, since handling is particularly easy as a result, and the carrier 15 can be brought easily and quickly both into its neutral position (in line with the carrier 11) and into its operating position (angled-away position in relation to the longitudinal axis of the carrier 11).

In FIGS. 3 and 4, the device 10 actually arranged partially in the mortar barrel 3 is represented once again in its neutral position (FIG. 3) and in its operating position (FIG. 4).

The device 10 according to FIG. 3 has been pushed completely into the mortar barrel 3 in the neutral position. Only the upper end region of the operating unit 17 protrudes from the end of the mortar barrel 3 or finishes flush with it. In this state, the two antennas 16, if present, assume a distance D1.

In the operating position of the device 10 according to FIG. 4, it has been moved out of the mortar barrel 3 to such an extent that not only has the operating unit 17 with the antenna 16 alongside it been moved out of the mortar barrel 3, but also the second antenna 16, at a distance therefrom, has become accessible. This means generally that the carrier 11 of the device 10 must be moved out from the mortar barrel 3 to the extent that it is made possible to bring at least the carrier 15 with its at least one antenna out of the position in line with the carrier 11 into a position moved out from it. This takes place in the exemplary embodiment by the carrier 15 being brought into its operationally ready position according to FIG. 4 about the pivoting point 19 in relation to the carrier 11. If only one antenna 16 is present, it is sufficient to move the carrier 11 out from the mortar barrel 3 to the extent that it is made possible as a result to bring the carrier 15 out of the previously in-line position in relation to the carrier 11 from this in-line position, in particular to pivot it about the pivoting point 19.

If, however, an antenna 16 is respectively present in the end region of the carrier 15, that is to say therefore two antennas 16 at the distance D1, the carrier 11 must be moved out from the mortar barrel 3 to such an extent that it is possible as a result to bring the two antennas 16 arranged in the end region of the carrier 15 into their operating position.

It is conceivable that the at least one antenna 16 is arranged at the end of the carrier 15. If two antennas 16 are arranged, they are arranged at the respective end of the carrier 15. This means that the distance D1 between the two antennas 16 also corresponds approximately to the length of the carrier 15. It is particularly advantageous to provide the pivoting point 19 at exactly half the distance D1, in order in this way to achieve a symmetry. This is not necessarily required, and so the pivoting point 19 may also be provided outside the midpoint of the distance D1.

If the two antennas 16 are arranged directly at the end of the carrier 15, the distance D1 in the neutral position is equal to the distance D2 in the operating position of the device 10.

It may however be required to increase the distance D1 between the two antenna 16 in the neutral position of the device 10. According to FIG. 4, a linkage 20 is present for this purpose. With this linkage 20 it is possible to increase the distance between the two antennas 16 with respect to the end region of the carrier (or else only one antenna 16). Particularly advantageously, the linkage 20 is axially displaceable in relation to the carrier 15. It may be secured for example by a screw 21 both in the retracted state and in the extended state. In this case, the at least one antenna 16 is located in the end region of the carrier 15 in such a way that the antenna 16 lies directly against the end of the carrier 15 in the neutral position of the device 10 and, by extending the linkage 20, moves away from this end of the carrier 15 in the operating position.

In FIG. 4, a corresponding symmetrical structure is shown, that is to say that two linkages 20 are provided on the carrier 15, secured by way of screws 21 both in the extended position and in the retracted position of the linkage 20. The two antennas 16 are arranged in the end region of the linkage 20. This symmetrical structure is of particular advantage because identical parts can be used, in particular for the linkage 20. However, it is also possible to depart from this symmetrical type of construction. The linkage 20 makes it possible to increase, for example double, the distance D1 of the two antennas 16 from one another in the neutral position of the device 10 to a distance D2 in the operating position of the device 10. Should even greater distances be required, it may be considered to design the linkage 20 as a telescopic linkage to achieve the desired extension with at the same time a compact type of construction.

Finally, a cover 23 of the operating unit 17 is also shown in FIG. 4. The cover 23 may be a separate component. Particularly advantageously, however, it may also be captively present on the operating unit 17, for example in such a way that it can be pivoted or can be screwed. With the cover 13, the end of the mortar barrel 3 is closed, in particular in the neutral position of the device 10, that is to say when it is fully retracted in the mortar barrel 3. As a result, the operating and/or indicating elements of the operating unit 17 are then also covered in a protected manner. The operating unit 17 may possibly also be covered with the cover 23 during the operating position of the device 10. If the cover 23 is an independent element, it may for example be fitted flush in the mortar barrel 3 or extending over it, be screwed or the like.

The invention is described once again and to a further extent below:

Mortars are barrel weapons that fire at a steep angle and can engage targets behind cover. The target is aimed at indirectly, with the aid of reference points defined by surveying techniques. The weapon system is aligned manually. For the simulation of a mortar for training and/or practice purposes, communication between the mortar and the target by means of a laser (known as "Laser Pairing") is not possible because of the indirect aiming. Instead, a system known as "Geo Pairing" has to be used. With Geo Pairing, the location at which the shell makes impact is determined on the basis of the position of the firer and the target, the point in time at which the shell is fired, the orientation vector of the weapon and the characteristics of the weapon and the ammunition. With the mortar, Geo Pairing with the aid of magnetic sensors is inaccurate because of the great steel mass and the usually multi-personnel operating team and the resultant magnetic disturbances. A better option is the use of a GNSS-aided Geo Pairing system. GNSS stands for "Global Navigation Satellite System" and is a generic term for existing and future satellite systems, such as for example the US-American GPS. In order to achieve good measuring accuracy with such a system, a sufficiently great distance between two separate GNSS antennas is necessary. The necessary distance between the GNSS antennas creates problems for the mounting of the simulation device on the weapon system.

It is known to attach one GNSS antenna to the outside of the mortar, while the second GNSS antenna is set up at a great distance (10 to 20 meters) from the mortar. This embodiment however requires a number of individual components, extra logistical effort in transporting the weapon (additional boxes and devices) and simulation-necessitated structures that deviate considerably from the "real weapon".

For the simulation of a mortar, the invention provides a compact, GNSS-aided device that can be accommodated inside the mortar barrel, remains in it during the practice exercise and can be used without external components.

All of the components of the device are initially arranged inside the mortar barrel and are only extended out of the mortar barrel when the mortar is set up in the firing position. There is consequently no risk of the device being damaged during transport of the mortar, since no parts are arranged on the outside of the mortar. Also, with the device according to the invention, no additional transporting containers are necessary; the device does not require any further components (sensors, cables, etc.). The original weapon does not have to be modified and can be used without any conversion or enhancement.

The device according to the invention is pushed into the mortar barrel and has in the region of the muzzle a clamping device with which it is fixed in a friction-locking manner with respect to the mortar (FIG. 2).

This clamping device is connected by way of a guiding linkage to an element for picking up the trigger, i.e. for detecting the firing of a shot (FIG. 1, trigger box). This element is referred to hereinafter as the trigger box. The guiding linkage at the same time forms a safeguard against twisting of the device about the axis of the barrel bore. In the region of the trigger pickup there are further functional elements, which bring about a radial clamping inside the mortar barrel. After a one-off setting-up operation, the device is mounted captively, in particular securely in terms of twisting, and remains connected to the mortar barrel during the entire practice exercise.

The trigger box is exchangeable as a functional element. For this, corresponding interfaces for the mechanical fastening (threads, attachment areas or the like) and the electrical connection (connectors or the like) of the trigger box are provided on the device according to the invention. In a preferred embodiment of the invention, not a mechanically functioning trigger box but a trigger box that is triggered by means of electrical voltage is used.

A movable part of the device is linearly displaceable inside the barrel in the direction of the axis of the barrel bore on a guiding linkage. Mounted inter alia on this movable component are the functional elements of the device, such as for example the GNSS antennas, the control unit and also the operating and indicating elements (switches, rotary knobs, etc.). If the mortar is brought into the firing position, this part is extended out from the barrel and the functional elements protrude at least partially out of the mortar barrel. Once the functional elements have been extended out of the barrel, the frame on which the functional elements are attached can be pivoted about at least one axis (FIG. 3, FIG. 4). The pivoting angle or angles can be limited by the operator and can be fixed in a desired position. Moreover, the frame can be adjusted in length outside the mortar barrel, that is to say telescoped. This has the effect of increasing the distance between the GNSS antennas attached to the respective ends of the frame. The length adjustment can likewise be limited by the operator and can be fixed in a desired position. In addition, the GNSS antennas are also pivotable about at least one axis and can be fixed in a preferred position.

There is no change from the way in which the original weapon is operated for firing a shot. The firing of a shot is detected at the firing pin of the mortar; the way in which it is operated does not differ from the firing of a real shot.

The device according to the invention can compensate for the production-related tolerances of the original weapon. Furthermore, the device can be changed in length, and so can be adapted to different makes of mortar.

In a preferred embodiment, the device is intended for a minimum diameter of the mortar barrel and can be adapted by means of additional elements, such as adapters or actuating elements, to other, larger barrel diameters or weapon calibers.

The device can be easily disassembled and dismantled into segments and consequently can be logistically handled well.

LIST OF DESIGNATIONS

1. Mortar
2. Stand
3. Mortar barrel
4. Base plate
10. Simulation device
11. Carrier
12. Guiding linkage
13. Trigger box
14. Control unit
15. Carrier
16. Antenna
17. Operating unit
18. Linear guide
19. Pivoting point
20. Linkage
21. Screw
22. Guiding element
23. Cover

The invention claimed is:

1. A device for simulating a mortar, comprising:

a trigger box, a control unit, at least one antenna and an operating unit;

a stand, which is arranged on a mortar barrel, and a base plate for setting up the mortar, the device being arranged almost completely in the mortar barrel in a neutral position and protruding from the mortar barrel in an operational position out of the mortar barrel in comparison with the neutral position.

2. The mortar as claimed in claim 1, characterized in that the device comprises a carrier and a further carrier that is pivotable in relation thereto, the longitudinal axis of the carrier being arranged in the longitudinal axis of the mortar barrel both in the neutral position and in the operating position of the device.

3. The mortar as claimed in claim 2, characterized in that the carrier is provided with a guiding linkage that is movable in the longitudinal direction.

4. The mortar as claimed in claim 2, characterized in that the trigger box is arranged at the end of the carrier that is remote from the further carrier.

5. The mortar as claimed in claim 2, characterized in that the control unit is arranged on the carrier.

6. The mortar as claimed in claim 2, characterized in that the at least one antenna is arranged in the end region of the further carrier.

7. The mortar as claimed in claim 2, characterized in that two antennas are arranged respectively in an end region of the further carrier.

8. The mortar as claimed in claim 6, characterized in that at least one linkage is provided on the further carrier, movably in relation thereto, the one end of the linkage being mounted on the carrier and the antenna being arranged at the other end of the linkage.

9. The mortar as claimed in claim 1, characterized in that the operating unit is arranged at one end of the further carrier, and closes the open end of the mortar barrel in the neutral position of the device.

* * * * *